US005240564A

United States Patent [19]

Niskanen et al.

[11] Patent Number: 5,240,564

[45] Date of Patent: Aug. 31, 1993

[54] METHOD FOR THE CONTROL OF THE NIP-PRESSURE PROFILE IN A PAPER MAKING MACHINE

[75] Inventors: Tapio Niskanen; Kvösti Uuttana, both of Jyväskylä , Finland

[73] Assignee: Valmet Paper Machinery Inc., Finland

[21] Appl. No.: 844,723

[22] Filed: Mar. 2, 1992

Related U.S. Application Data

[63] Continuation of Ser. No. 533,480, Jun. 15, 1990, abandoned.

[30] Foreign Application Priority Data

Jun. 6, 1989 [FI] Finland ..... 892757

[51] Int. Cl.[5] ..... D21F 3/00

[52] U.S. Cl. ..... 162/358.1; 162/198; 162/252; 162/263

[58] Field of Search ..... 162/206, 198, 358.1, 162/202, 252, 263; 100/38, 93 RP

[56] References Cited

U.S. PATENT DOCUMENTS

| | | | |
|---|---|---|---|
| 1,714,261 | 5/1929 | Egan | 162/361 |
| 2,209,761 | 7/1940 | Berry | 92/49 |
| 3,177,799 | 4/1965 | Justus | 100/93 |
| 3,203,678 | 8/1965 | Sawyer et al. | 263/6 |
| 4,370,923 | 2/1983 | Schmidt | 100/47 |
| 4,432,277 | 2/1984 | Hartmann | 100/37 |
| 4,642,164 | 2/1987 | Hanhikoski et al. | 162/207 |
| 4,653,396 | 3/1987 | Wennerberg | 100/38 |
| 4,691,449 | 9/1987 | Wilberg | 34/9 |
| 4,738,752 | 4/1988 | Busker et al. | 162/359 |
| 4,748,906 | 6/1988 | Ashmore | 100/93 RP |

FOREIGN PATENT DOCUMENTS

| | | | |
|---|---|---|---|
| 2845995 | 4/1979 | Fed. Rep. of Germany | 162/253 |
| 3542342 | 5/1986 | Fed. Rep. of Germany | 100/38 |
| 2127871 | 4/1989 | United Kingdom | 162/198 |

OTHER PUBLICATIONS

Papermaking and Paperboard Making, 2nd Ed., vol. II (1970) pp. 624–625.

*Primary Examiner*—W. Gary Jones
*Assistant Examiner*—Brenda Lamb
*Attorney, Agent, or Firm*—Steinberg & Raskin

[57] ABSTRACT

A method and apparatus in the press section of a paper machine for regulating the axial linear-load profiles in its nip or nips ($N_1$,$N_2$,$N_3$). The axial temperature profile(s) of the outer mantle(s) of a press roll or rolls (11, 13, 16, 17) is/are regulated. Thereby, the distribution of the diameter of the press roll in the axial direction is controlled on the basis of thermal expansion. Also thereby, the distribution in the transverse direction of the machine of the linear load in the press nip or nips ($N_1$,$N_2$,$N_3$) formed by the press roll or rolls (11, 13, 16, 17) is affected. The temperature profile of the outer mantle(s) (11', 13',17') of the press roll or rolls (11, 13, 17) is regulated by a press felt or felts (10, 14, 18) running through the press nip or nips ($N_1$, N2, N3) formed by the roll applying a heating/cooling effect whose profile in the axial direction of the roll is regulated, and/or by applying a set of water jets (F) directly onto the outer mantle(s) of the press roll or rolls, the jets' quantity distribution ($F_1$ . . . FN) and/or temperature distribution ($T_1$ . . . TN) being regulated so as to obtain the desired distribution of np-pressure profile.

7 Claims, 3 Drawing Sheets

METHOD FOR THE CONTROL OF THE NIP-PRESSURE PROFILE IN A PAPER MAKING MACHINE

This is a continuation of application Ser. No. 07/533,480, filed Jun. 15, 1990, now abandoned.

The invention relates to a method usable in the press section of a paper or paperboard making machine for regulating the axial linear-load profile(s) in a press nip or nips, in which method the axial temperature profile(s) of the outer mantle(s) of a press roll or rolls is/are regulated and thereby the variation of the diameter of the press roll in the axial direction is controlled on the basis of thermal expansion, whereby distribution, in the transverse direction of the machine, or the linear load in the press nip or nips formed by the press roll or rolls is affected.

The invention further relates to a press section of a paper machine, comprising at least two, most appropriately more than two, press rolls, which rolls form a press nip; or nips with each other, through which nips one or several press felts are passed.

To remove water out of a paper or paperboard web, press nips are commonly used, which are formed between two opposite press rolls and a press felt or felts running between these rolls. In a press nip, the felt and the paper are compressed so that the water contained in them fills the open space substantially completely. Within the press zone, and possibly also to some extent thereafter, the water that escapes from the web enters into the hollow faces of the press rolls, which faces are made "hollow" by the provision of such openings as grooves or bores therein. This construction results in the moisture profile of the felt or felts entering into the press nip hardly affecting the moisture profile of the paper or paperboard departing from the nip. Thus, the press nip tends to equalize the moisture profiles of the web and of the felt in accordance with the transverse distribution of the linear load in the nip.

The linear load profile in the transverse direction of the paper making machine that exists in the press nip has a direct effect on the corresponding moisture profile of the web compressed in the nip, so that the higher the linear load in the nip, the higher becomes the dry solids content of a paper web as it leaves the nip. On the other hand, the linear load in the nip must be kept below a certain limit in order that the compression process should take place without destruction of the fiber structure of the web.

As is known from the prior art, attempts have been made to affect the transverse distributions of linear loads in press nips by means of variable-crown or adjustable-crown rolls (as stated hereinafter, variable-crown rolls), in which, inside the roll mantle, there are a number of hydraulically loaded glide shoes placed side by side. By means of these variable-crown rolls, it is, however, not possible to alter the distribution of the linear load in a press nip very abruptly or at a very precise location in the nip. However, by using rolls adequate in zones thereof, it is also possible to adjust local faults in the distribution of linear load, which cannot be accomplished by means of normal so-called floating variable-crown rolls.

It is known from the prior art, in press rolls and calender rolls, to employ inside temperature profiling of the roll mantle such that the roll is divided into separate zones in the axial direction, into which respective zones mediums of different temperatures are passed, whereby the radius of the roll is altered based on thermal expansion. In this way it is possible to change the linear load profile in a press nip or calendering nip quite abruptly.

In the prior art, profiling devices placed outside calendering rolls are also known, which are based either on hot-air blowing or on inductive heating. With respect to such structures, reference is made by way of example to the U.S. Pat. Nos. 3,489,344 and 3,770,578.

It is a commonly recognized drawback of the prior-art roll presses that the temperature profile of the roll mantle in the axial direction is not even close to being uniform. The lateral areas in the mantles of variable-crown press rolls are colder or hotter than the middle area. The axial temperature gradient of a press-roll mantle can be as high as about 20° C./m. Temperature gradients of this order, and even lower gradients, cause such abrupt changes in the linear load profile of a roll nip that, generally, these changes cannot be completely controlled by means of the prior-art variable-crown rolls or by other means known in this prior art.

The temperature gradient of a roll mantle is dependent on such factors as the reconditioning of the press felt, the effect of air flows, the different physical and chemical properties of respective rolls, such as the thermal energy generated by the end bearings of a variable-crown roll, and the thermal energy introduced by the web.

As stated previously, the temperature gradient of a roll mantle is partly a result of the reconditioning of the press felt, because the felt absorbers produce an uneven felt moisture profile such that in its lateral areas the felt has a higher moisture content than the middle area. This moisture profile of the press felt is "copied" in the temperature profile of the roll in that, the higher the moisture content in a certain area of the felt is, the colder becomes the portion of the press roll that is in direct contact with the felt in that certain area.

In recent years, attempts have been made to develop various rolls to substitute for rolls made of rock in paper making machines, such as metal rolls, in connection with which the profiling problems of the web have been further aggravated.

SUMMARY OF THE INVENTION

An object of the present invention is to provide a novel method and apparatus through which the drawbacks discussed above can be substantially avoided.

More specifically, it is a further principal object of the present invention to provide such a method and apparatus for regulation of the linear load profile in a roll nip which have the advantages of simple construction and operation and by whose means it is possible to produce sufficiently abrupt changes of required magnitude in the axial temperature profile of a roll and, by the effect of thermal expansion, also in the linear load profile in a press nip formed by the same roll.

With a view to achieving the objectives stated above and those that will be apparent from the description hereinafter, the method of the invention comprises the temperature profile of the outer mantle(s) of the press roll or rolls being regulated by a press felt or felts running through the press nip or nips formed by the press roll and thereby applying a heating/cooling effect whose profile in the axial direction of the roll is regulated, and/or by directing a plurality of water jets onto the outer mantle(s) of the press roll or rolls, the jets' quantity distribution and/or temperature distribution being regulated so as to obtain a desired distribution in the nip-pressure profile.

A first embodiment of the equipment of the invention comprises, in the proximity of the press felt, before the felt enters the press nip, a profiling heating device extending substantially over its entire width is fitted, such as a radiator device, a jet pipe, or a corresponding temperature profiling system, which comprises a series of jet nozzles, through which a heating effect of regulated quantity profile and/or temperature profile can be applied to the felt placed in the proximity of the nozzles.

A second embodiment of the equipment of the invention comprises, in connection with one or several of said press-roll mantles, a jet pipe being fitted through which a set of water jets of regulated quantity and/or temperature profile is applied directly onto said roll face.

In the method in accordance with the invention, when the press roll is profiled by the intermediate of a felt running over the roll, in addition to, or instead of, a set of water jets, it is also possible to employ other heating/cooling media, such as air, or known radiation heating methods, such as heating by various electromagnetic types of radiation, such as microwave and/or infrared radiation. If air blowing is applied, in some places in the press section difficulties may occur because such large quantities of air are required that they cause disturbance in the running of the felts or the web. When sets of water jets are employed, the necessary amounts of heat can be transferred by means of relatively small amounts of water, which may be just of an order of 10–20 g/s/meter of felt width. When sets of water jets and, in a corresponding manner, air are employed, in the press roll profiling it is also possible to make use of cooling methods whose use is not possible when radiation heating is employed.

The invention can also be practiced by making use of temperature profiling applied directly to the roll face, but, when used alone, this is not the most advantageous embodiment of the invention. In temperature profiling applied directly to the press-roll mantle, within the scope of the present invention, a set of water jets is used, whose quantity and/or temperature distribution is regulated.

BRIEF DESCRIPTION OF THE DRAWINGS

In the following, the invention will be described in detail with reference to some exemplifying embodiments of the invention illustrated in the Figures in the accompanying drawing, the invention not being confined to the details of the embodiments.

DESCRIPTION OF THE PREFERRED EMBODIMENTS

Figure 1:
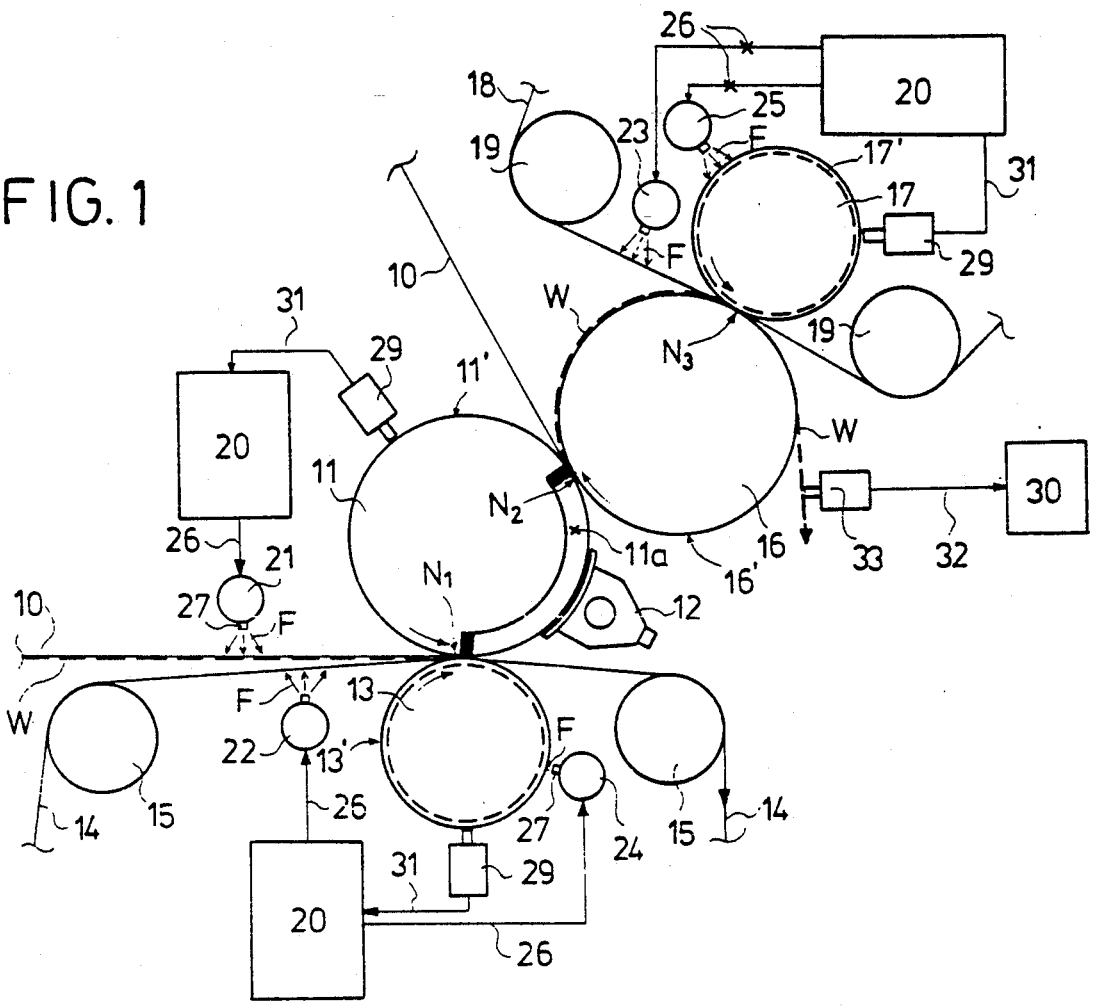
FIG. 1 is a schematical side view, and partially a block diagram illustration, of a compact press in which a regulation method and apparatus in accordance with the invention is applied.

The arrangement of rolls shown in FIG. 1 is known in the prior art. This compact press section is marketed by the Applicant under the trade mark SYM-PRESS II ®. The press shown in FIG. 1 comprises three subsequent press nips $N_1$, $N_2$, $N_3$, wherein the first nip $N_1$ is formed between a hollow lower roll 13 which has a hollow face 13' and a suction roll 11. The first nip $N_1$ is a two-felt nip, and through the nip the upper felt 10 and the lower felt 14 run, the latter being guided by the guide rolls 15. The upper felt 10 also acts as a pick-up felt and carries the web W on its lower face into the first nip $N_1$ and transfers the web W from it further over the suction zone **11*a* of the suction roll 11 into the second nip $N_2$. The second nip $N_2$ is formed between the suction roll 11 and center roll 16 which has a smooth face 16'. In connection with the center roll 16, the third nip $N_3$ is formed together with the press roll 17, which has a hollow face 17'. The felt 18 in the third nip $N_3$ is guided by the guide rolls 19**.

After the third nip $N_3$, the web W is detached from the smooth face 16' of the center roll 16 and transferred, e.g., onto a drying wire (not shown). The center roll 16 is, e.g., a roll made of rock or a roll with a metal body. In a position facing the suction zone **11*a* of the suction roll 11, a steam box 12** is fitted, by whose means the temperature level in the web W is raised, and thereby the draining of water in the second and third nips $N_2$, $N_3$ is intensified. The press roll construction described above is known in the prior art, and it is described in this connection just to facilitate an understanding of the background of the invention and as a basis for an exemplifying embodiment of the invention.

Figure 2:
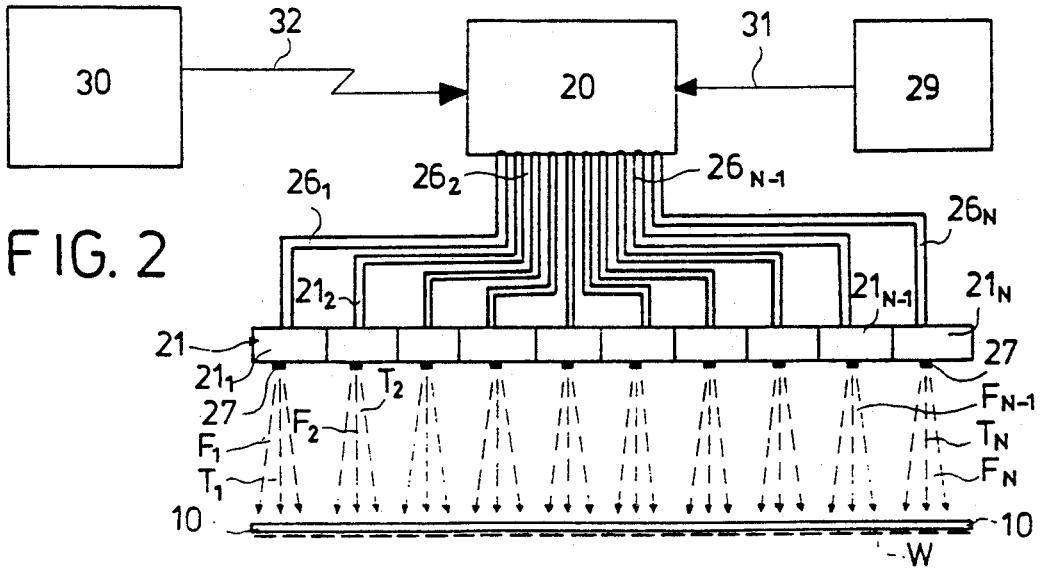
FIG. 2 shows the embodiment of the regulation method and apparatus shown in FIG. 1 in a plane transverse to the paper making machine.

As is shown in FIG. 1, to practice the present invention, inside the loop of the press felt 10, a jet pipe 21 is fitted, which is divided into sections $\mathbf{21}_1 \ldots \mathbf{21}_N$ in the transverse direction in the manner shown n FIG. 2, the number of these sections being, consequently, N. The various sections in the jet pipe 21 are provided with nozzles 27, and each section communicates, via a pipe $\mathbf{26}_1 \ldots \mathbf{26}_N$ of its own, with a flow supply and regulation unit 20. By means of the unit 20, it is possible to control the flow-quantity profile $F_1 \ldots F_N$ and/or the temperature profile $T_1 \ldots T_N$ of the water passing through each nozzle 27. Through the series of nozzles 21, a series of water jets is applied to the inner face of the felt 10 before it reaches the nip $N_1$, the temperature profile $T_1 \ldots T_N$ and/or the flow-quantity profile $F_1 \ldots F_N$ of this series of water jets being adjustable in accordance with the invention. In this way, it is possible to control the moisture profile and the temperature profile of the felt 10 entering into the nip $N_1$ such that the axial temperature profile and, thereby, the diameter profile of the mantle 11' of the roll 11 in direct contact with the felt 10 can be made such that, both in the nip $N_1$ and in the nip $N_2$, the transverse distribution of linear load that is desired is produced. In the invention, generally, the present value is a uniform temperature profile of the press roll mantle, whereby the final adjustment of the nip pressure profile in the nip $N_1$ can be carried out in a precise manner, e.g., by using an adjustable-crown roll such as the lower roll 13 in the nip $N_1$, the regulating capacity of this lower roll, in such a case, facilitating this final adjustment.

Also, as shown in FIG. 1, a jet pipe 22 corresponding to the jet pipe 21 described above is also fitted inside the loop of the lower felt 14 in the first nip $N_1$, and a set of water jets of adjustable quantity and/or temperature profile can be fed through the series of nozzles 2 in the nozzle pipe 22 onto the inner face of the felt 14, and by means of this regulation it is possible to act upon the temperature profile of the mantle 13' of the roll 13 and, thus, also upon the linear load profile in the nip $N_1$ in the manner described hereinbefore.

Moreover, in FIG. 1, a third jet pipe 23 is fitted inside the loop of the felt 18, which jet pipe 23 operates in the same manner as the jet pipes 21 and 22 and regulates the temperature profile of the mantle 17' of the press roll 17 in the third nip $N_3$ and, thereby, the distribution of the linear load in the nip $N_3$.

It should be emphasized in this connection that, even though hereinbefore and hereinafter the invention is described with reference to temperature profiling produced by means of a set of water jets only, instead of water it is also possible to use other heating/cooling media, such as air. In addition to, or instead of, temperature profiling of a press felt taking place by means of a medium or a plurality of media, it is also possible to use various modes of radiation heating, such as microwave and/or infrared heating, by means of which an electrically controlled transverse temperature profiling of a felt can be facilitated. However, generally, water is the most advantageous heat-transfer medium, because only a relatively small amount of water is required and, when water is used, in roll profile regulation it is also possible to make use of cooling. If, in the invention, temperature profiling applied directly to the press roll mantle is employed alone or, as is preferable, together with profiling of a felt, set of water jets is used in the profiling applied directly to the roll mantle.

In FIG. 1, such an alternative embodiment of the invention is illustrated in accordance with which the jet pipes 24 and 25 operate through whose sets of nozzles 27 sets of water jets F of adjustable quantity and/or temperature profiles can be fed directly onto the respective mantles 13';17' of the rolls 13;17, and thereby it is possible, alone or together with the jet pipes 21, 22 and/or 23, to control the axial temperature profile of the rolls 13, 17 and the distributions of nip pressures.

Generally, all of the jet pipes 21, 22, 23, 24, 25 shown in FIG. 1 are not needed at the same time, and according to a preferred embodiment of the invention, just the jet pipes 21, 23 spraying onto the felt 10 common to the first and the second nips $N_1$, $N_2$ and onto the felt 18 of the third nip $N_3$ are used.

As is shown in FIG. 1, in connection with, or in the proximity of, the respective mantles 11', 13', 17; of the rolls 11, 13, 17, a device for measurement of the axial temperature profile is placed, which device, according to FIG. 1 comprises a series of detectors or a traversing detector 29, which gives a measurement message to a calculating apparatus 20 which can be a computer, through a conductor or conductors 31. The unit 20 is preset or programmed to output predetermined, preferably uniform temperature profiles of the mantles of the rolls 11, 13, 17.

In connection with the control system in accordance with the invention, if desirable, it is also possible to include apparatus for the measurement of the moisture profile of the web W departing out of the press. In FIGS. 1 and 2, such an apparatus is illustrated schematically by a block 30 and by a related series of detectors 33 for measurement of the moisture profile or a traversing moisture detector. Such a system of moisture-profile measurement, which is not always necessary, may be helpful when the set values of the control system are being formed so that a moisture profile, usually desired to be as uniform as possible, is produced for the web W departing from the press.

Figure 3:
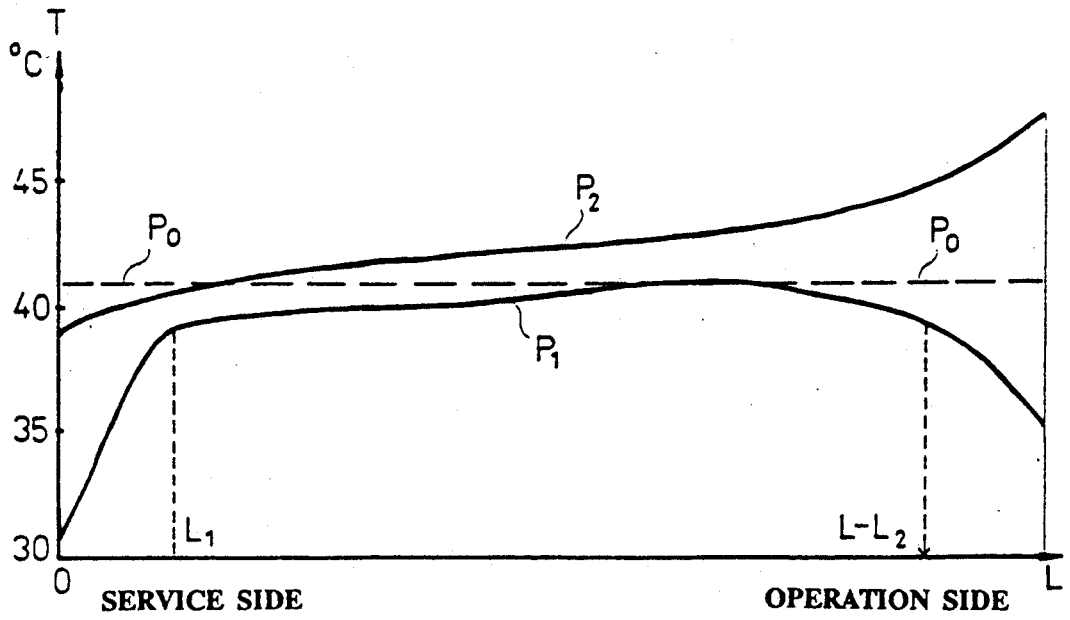
FIG. 3 illustrates typical surface temperature profiles of the center roll and of a variable-crown roll in the press shown in FIG. 1 without a regulation method in accordance with the invention.

FIG. 3 illustrates the typical surface-temperature profiles of press rolls without a regulation method in accordance with the invention. The profile $P_1$ represents a typical temperature profile of the outer face 16' of a center roll 16 similar to that shown in FIG. 1 over the entire length L of the roll mantle. Both at the service side of the roll 11 within the length $l_1$ and at the operation side of the roll, within the length $l_2$, there is quite a steep temperature gradient. The profile $P_2$ is a typical temperature profile of the mantle 13' of a variable-crown lower roll 13 in a press similar to that shown in FIG. 1. The profile $P_2$ shows that the temperature of the roll mantle is about 10 degrees higher at the operation side than at the service side. By means of the present invention, generally, a uniform temperature profile of the roll mantle is aimed at, such a profile being, in FIG. 3, represented by the dashed line as the profile $P_o$.

Figure 4:
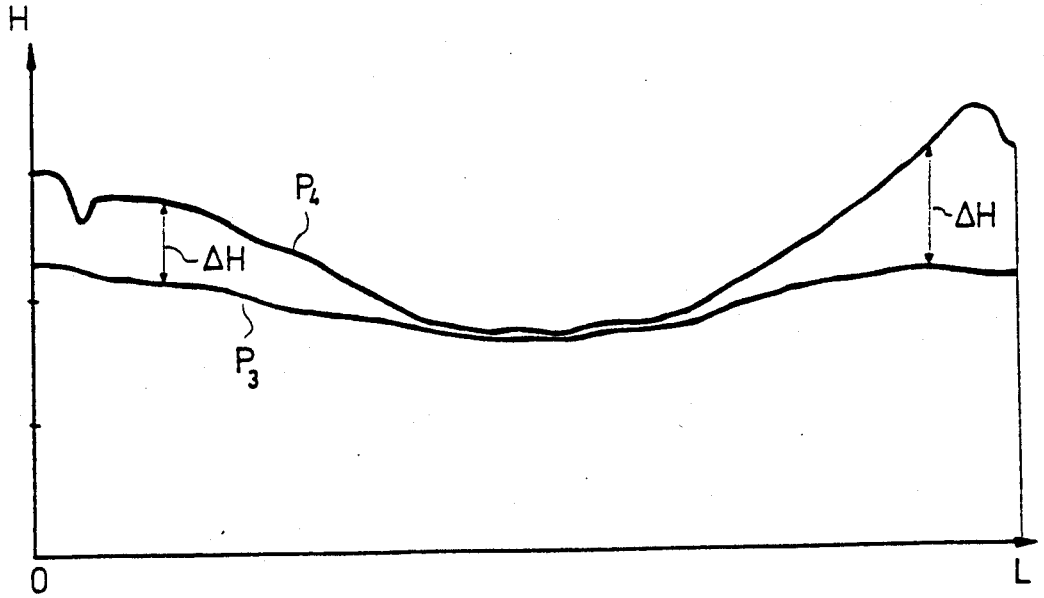
FIG. 4 illustrates typical moisture profiles of a press felt before and after passing through a press nip before introduction of the method of the invention.

FIG. 4 illustrates typical moisture profiles of a press similar to that shown in FIG. 1 without the effect produced by the method of the invention. In FIG. 4, the profile $P_4$ represents the moisture profile H of the press felt 10 before it reaches the nip $N_1$, and the profile $P_3$ represents a corresponding moisture profile of the felt 10 after it leaves the nip $N_1$. It is noted that the moisture content in the lateral areas of the felt 10 entering into the nip $N_1$ is higher than its moisture content in the middle area, and that in the lateral areas of the roll 11 the moisture profile is lowered in the nip $N_1$ by a considerably greater amount than in the middle area. This lowering of the moisture profile is denoted by $\Delta H$ in FIG. 4.

Figure 5:
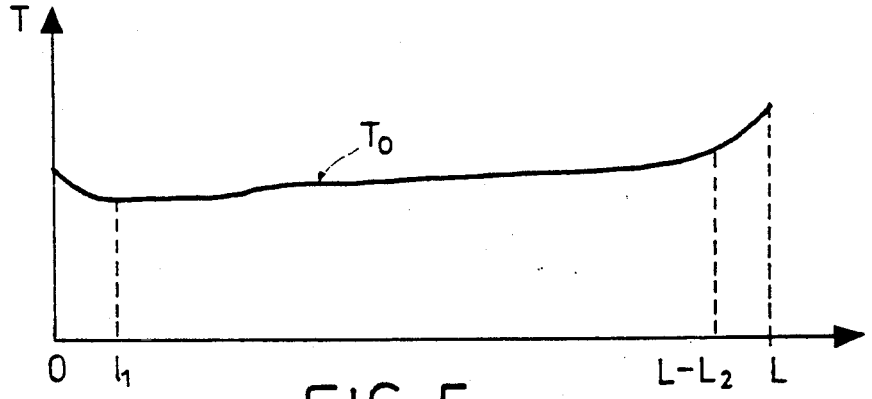
FIG. 5 illustrates a typical temperature profile of a variable-crown roll as shown in FIG. 6 without a regulation method or apparatus in accordance with the invention.
Figure 6:
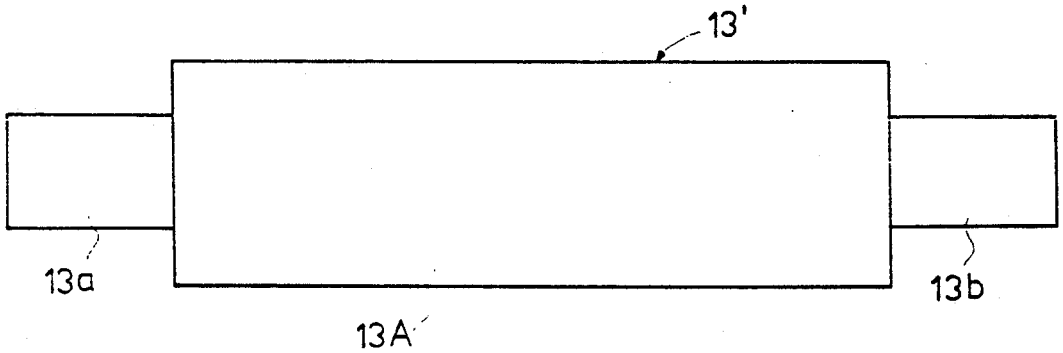
Figure 7:
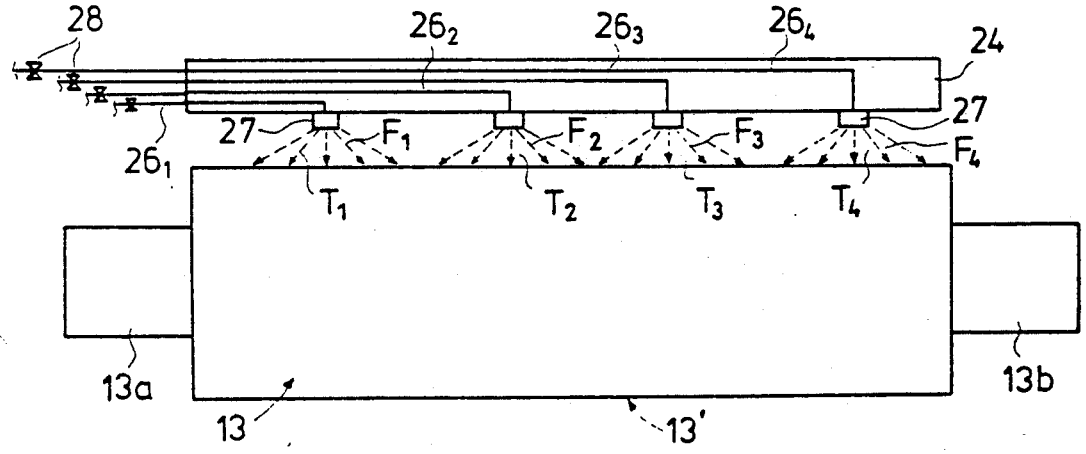
FIG. 7 shows a press roll in accordance with FIG. 6 as provided with a temperature profiling device acting directly upon the cylindrical mantle of the roll.

In the invention, if desirable, instead of, or, preferably, in addition to, the profiling taking place by the intermediate of a felt or felts, it is possible to use a set of water jets applied directly onto the mantle of a press roll, the distribution of these water jets being regulated in the axial direction of the roll with respect to their temperature and/or with respect to their quantity. This embodiment is illustrated by FIGS. 5, 6 and 7. FIG. 5 illustrates the temperature profile $T_o$ of the mantle 13' of a variable-crown roll 13A as shown in FIG. 6 over the length L of the roll mantle. As is shown in FIG. 5, in the variable-crown roll 13A, at the proximity of its ends, in the areas $l_1$ and $l_2$, there are considerable temperature gradients, so that in the proximity of the roll ends the temperature is higher than in the middle area of the roll 13A, because the lateral areas of the variable-crown roll 13A tend to be heated by the effect of warming up of the bearings (not shown) of the mantle. This anomaly of the temperature profile $T_o$ and other anomalies relating to the linear-load pressure profile within the press nips can be controlled and regulated in accordance with the invention by or through the set of nozzles 27 in the nozzle pipe 24 spraying water jets of adjustable temperature profile $T_1 \ldots T_4$ and/or quantity profile $F_1 \ldots F_4$ directly onto the face 13' of roll 13. The effect of the regulation may be, e.g., such that colder water is sprayed to the lateral areas $l_1$ and $l_2$ of the roll 13, whereby the water, when penetrating into the hollow face 13 of the mantle, cools the lateral areas efficiently, and the temperature profile $T_o$ shown in FIG. 5 consequently becomes substantially horizontal.

In temperature profiling applied directly to the press roll mantle, sets of water jets are used, because by means of water, especially in a hollow face of a press roll, efficient exchange of heat is achieved. Also, the amount of water that is needed is relatively small and, when water is used, it is also possible to use cooling in the profiling.

Details of the present invention may easily vary within the scope of the inventive concepts set forth above, which have been presented by way of example only. Therefore, the preceding description of the present invention is merely exemplary, and is not intended to limit the scope thereof in any way.

What is claimed is:

1. A method for regulating the axial linear-load of a press nip in a press section of a paper making machine, said method comprising the steps of:

causing a felt to run through said press nip and thereby contact a press roll forming said press nip; and treating said felt by applying a plurality of liquid water jets arranged in the cross-machine direction to said felt before said felt enters said press nip such that a temperature profile is produced in said felt which is copies on an outer mantle of said press roll forming said press nip, said felt producing a heating or cooling effect which is variable in the axial direction of the press roll such that said heating or cooling effect affects the variable diameter of said press roll in its axial direction through thermal expansion or thermal reduction of said press rolls such that a predetermined axial linear load profile in said press nip is achieved.

2. The method of claim 1, further comprising the steps of:

causing a plurality of water jets to impinge on an outer mantle of a press roll forming said press nip; and regulating the quantity distribution of water from said water jets impinging on said outer mantle so as to obtain a desired axial linear-load profile of said press nip.

3. The method of claim 1, further comprising the steps of:

causing a plurality of water jets to impinge on an outer mantle of a press roll forming said press nip; and regulating the temperature of water from said water jets impinging on said outer mantle so as to obtain a desired axial linear-load profile of said press nip.

4. The method of claim 1, further comprising the steps of:

causing a plurality of water jets to impinge on an outer mantle of a press roll forming said press nip; and regulating the quantity and temperature distribution of water from said water jets impinging on said outer mantle so as to obtain a desired axial linear-load profile of said press nip.

5. The method of claim 1, wherein said water jets are applied to both the inner and outer faces of said felt.

6. The method of claim 1, further comprising steps of measuring a temperature profile of an outer mantle of said press roll forming said nip and using measurements obtained thereby as feedback information for regulating said water jets in order to achieve said desired axial linear-load profile.

7. The method of claim 1, further comprising steps of measuring a transverse moisture profile of a paper or paperboard web after said web has passed through said press nip, and using a measurement signal obtained thereby as a feedback signal for regulating said axial linear-load profile.

* * * * *